United States Patent [19]

Burton

[11] 4,283,099

[45] Aug. 11, 1981

[54] LOCKER CABINET

[75] Inventor: Thomas A. Burton, Rochester, Minn.

[73] Assignee: Waters Instruments, Inc., Rochester, Minn.

[21] Appl. No.: 57,573

[22] Filed: Jul. 16, 1979

[51] Int. Cl.[3] ..... A47B 67/02

[52] U.S. Cl. ..... 312/351; 312/242; 312/245; 312/214

[58] Field of Search ..... 312/198, 199, 214, 242, 312/245, 257 R, 270, 351

[56] References Cited

U.S. PATENT DOCUMENTS

| | | | |
|---|---|---|---|
| 3,071,425 | 1/1963 | West | 312/205 |
| 3,612,633 | 10/1971 | Bloom | 312/245 |
| 3,848,942 | 11/1974 | Fanni | 312/198 |

*Primary Examiner*—Casmir A. Nunberg

*Attorney, Agent, or Firm*—James R. Haller; Steven G. Parmelee

[57] ABSTRACT

A cabinet, which may have a drawer, is assembled within a locker having side and rear walls and converging front flanges defining a door opening. The cabinet is provided with vertical side panels and at least one horizontal shelf panel. For assembly, the side panels are positioned within the locker against the side walls of the locker, and the shelf panel is mounted between the side panels to space the side panels a sufficient distance so as to prevent the cabinet from being withdrawn from the locker because of the restricted passageway provided by the locker flanges. The cabinet may have a drawer slideable between two parallel, vertically spaced shelf panels, the drawer having a width enabling it to be withdrawn through the door opening of the locker. Disclosed also are bracket means and bracket receiving means enabling ready assembly of the cabinet within a locker.

10 Claims, 7 Drawing Figures

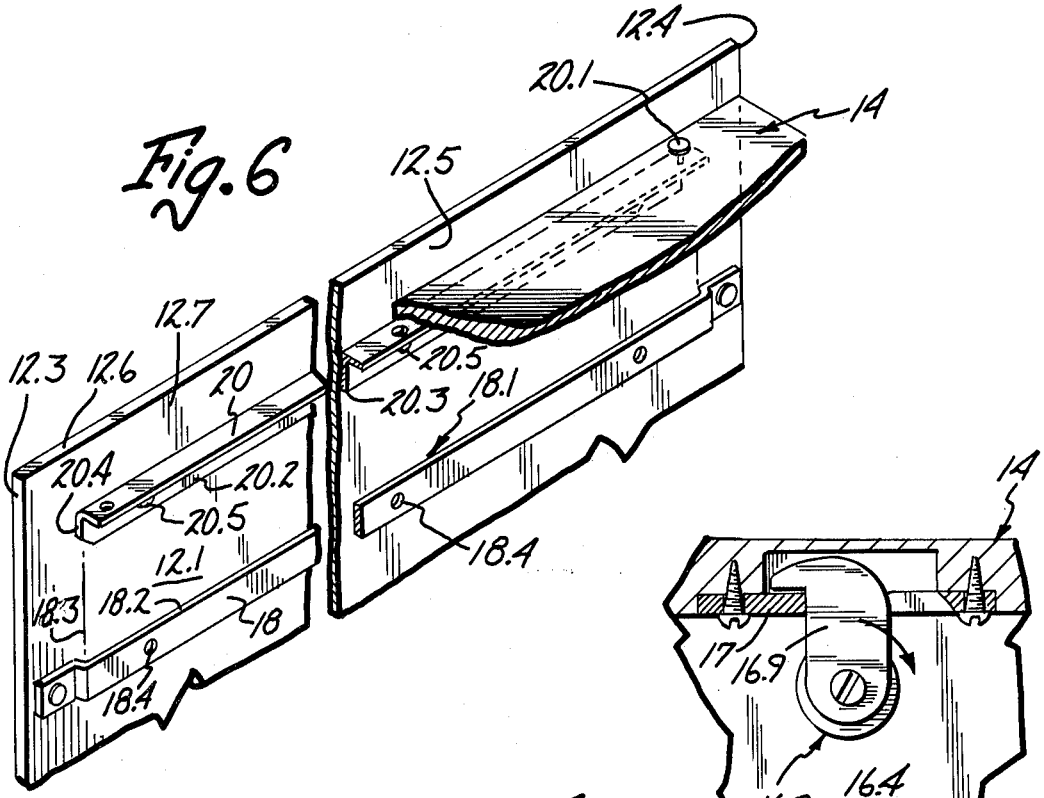
Fig. 6
Fig. 5
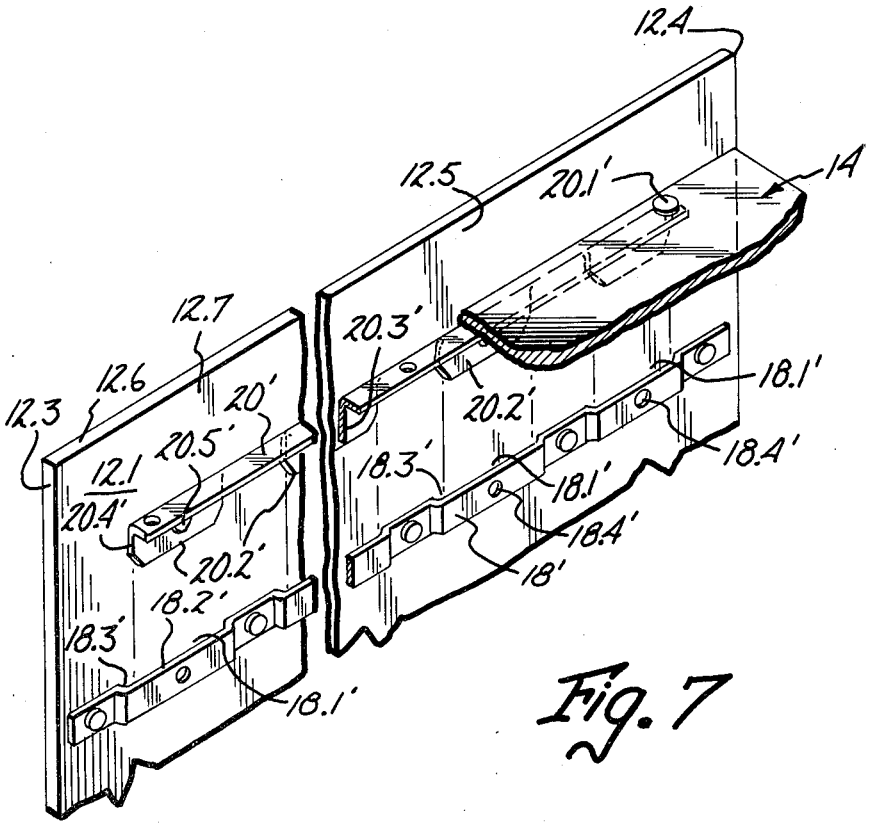
Fig. 7

LOCKER CABINET

BACKGROUND OF THE INVENTION

Lockers and locker rooms habitually are messy. Lockers which are employed in schools often are found with school books, papers, clothes and the like in great disarray. Lockers which are used in connection with athletic activities, such as in the locker rooms of country clubs, swimming pools and gymnasiums, are often similarly cluttered. Lockers generally are of steel, and have rear and side walls and a flange which defines a door opening. Such lockers ordinarily are provided with a top shelf attached to its side walls, and clothes hooks are positioned immediately beneath the shelf. Shoes, rackets, gym bags and other paraphernalia generally are stored in some disarray on the floor at the bottom of the locker. Items such as reading glasses, wristwatches and other jewelry ordinarily are either stored in the pockets of clothing in a locker, or are placed on the upper shelf often together with a bag containing toilet articles, and can easily fall from the locker to be broken or lost as the toilet bag is withdrawn from the upper shelf.

To build shelves or drawers or other storage compartments into existing steel lockers would be both difficult and expensive, and would likely involve the welding or riveting or other connection of metal shelves to the walls of the locker.

It would be highly desirable to provide a storage cabinet that could be easily assembled within a locker to neatly store various articles, and that, when assembled, would be impossible to remove from the locker without disassembly of the cabinet thereby making theft of the cabinet from the locker difficult.

SUMMARY OF THE INVENTION

The instant invention provides a cabinet which can quickly and easily be installed within the confines of existing lockers. In one embodiment, the invention provides a kit for assembling a cabinet in a locker, the kit having side panels for vertical placement against interior surfaces of the side walls of the locker and at least one horizontal shelf panel which is receivable between the side panels. Mounting means are provided to retain the shelf panel between the side panels, and the side panels are spaced from one another a sufficient distance to prevent them from being removed from the locker; that is, the flanges of the locker that define the door opening provide a restricted opening narrower than the width of the thus spaced side panels. The mounting means desirably includes bracket receiving means carried on confronting surfaces of the side panels, and bracket means carried by the shelf panels and engageable downwardly with the bracket receiving means. When thus assembled, attachment means may be employed to fix the bracket means to the bracket receiving means and thus prevent upward removal of the shelf panel from the side panels. A pair of horizontal shelf panels may be provided, the mounting means enabling the panels to be spaced vertically from one another to define a drawer-receiving opening, and the kit may include a drawer slideable between the shelf panels, the drawer having a width permitting it to be withdrawn from the shelf unit through the restricted opening between front flanges of the locker. If desired, lock means may also be provided to enable the drawer to be locked to one of the shelf panels defining the drawer opening.

Desirably, the bracket receiving means carried by the side panels includes respective upwardly and rearwardly facing surfaces, and the bracket means carried by the shelf panel includes downwardly and forwardly oriented respective surfaces for engaging the respective upward and rearward facing surfaces to restrain downward or forward movement of the shelf panel with respect to the wall panels.

In another embodiment, the invention relates to the combination of a locker and cabinet, as above described, the cabinet being retained within the locker by the horizontal shelf panels which space apart the side panels so that the cabinet as a whole has a width greater than the width of the door opening defined by the inwardly directed flanges of the locker, thereby preventing the cabinet from being withdrawn from the locker. In yet another embodiment, the invention relates to a method for installing a cabinet within a locker, both as above described, in which the side panels of the cabinet are first arranged within the locker in respective confronting relationship to the side walls of the locker, and at least one shelf panel is thereafter mounted between the side panels in such a manner as to space the side panels apart a sufficient distance to prevent them from being withdrawn through the door opening of the locker.

BRIEF DESCRIPTION OF THE DRAWING

FIG. 5 is a broken-away, cross-sectional view taken along line 5—5 of FIG. 2;

FIG. 6 is a perspective, broken-away, exploded view in partial cross-section showing bracket means and bracket receiving means of a cabinet of the invention; and FIG. 7 is a perspective, broken-away view, in partial cross-section similar to that of FIG. 6 but showing a slightly modified structure.

DESCRIPTION OF THE PREFERRED EMBODIMENT

Figure 1:
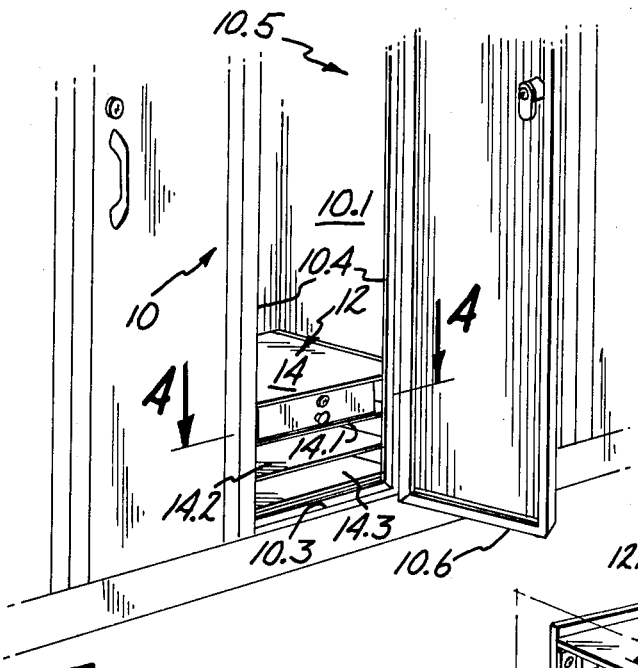
FIG. 1 is a broken-away, perspective view of a locker provided with a cabinet in accordance with the invention.
Figure 3:
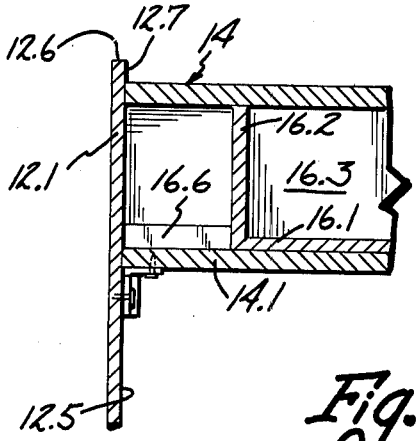
FIG. 3 is a broken-away, cross-sectional view taken along line 3—3 of FIG. 2.
Figure 4:
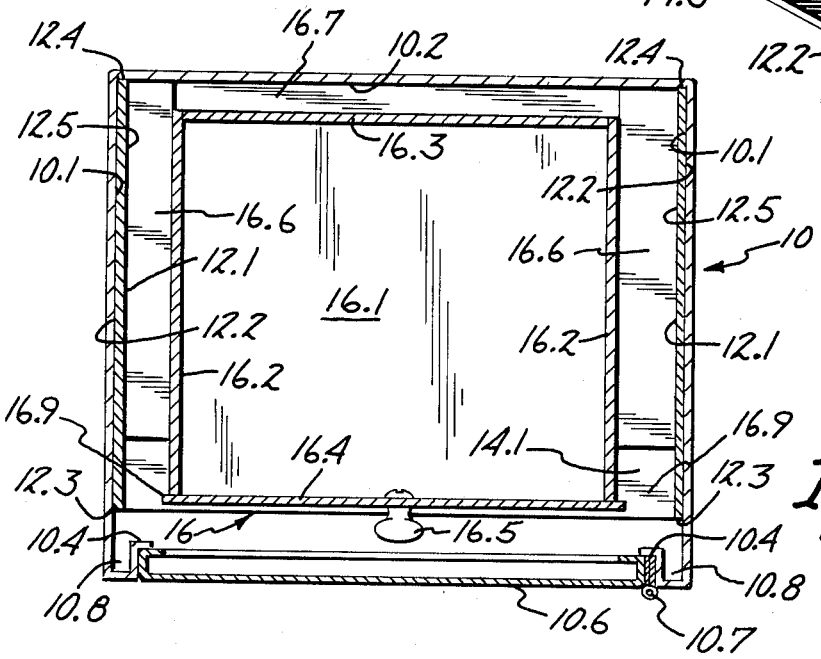
FIG. 4 is a cross-sectional view taken along line 4—4 of FIG. 1 and showing the cabinet installed in a conventional locker.

Referring first to FIGS. 1 and 4, a locker of the type commonly used in country clubs, swimming pool facilities and the like is designated generally as 10 and includes side walls 10.1, a rear wall 10.2, and a floor 10.3. Protruding inwardly from the front edges of the side walls are metal flanges 10.4 which define a locker door opening 10.5, the locker door 10.6 being usually hingedly connected to one of the flanges as shown at 10.7. The cabinet of the invention, designated generally as 12, is shown in position within the locker in FIG. 1.

Figure 2:
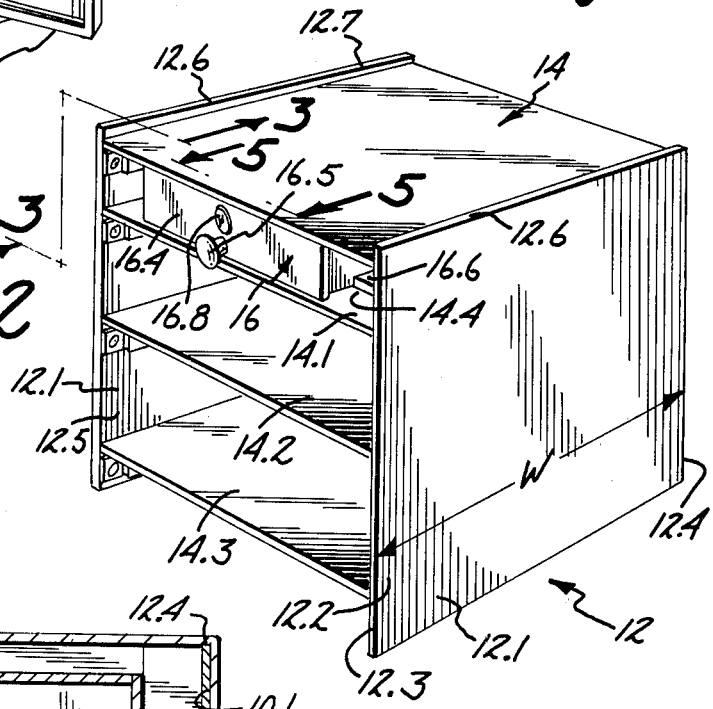
FIG. 2 is a perspective view of a cabinet of the invention.

Referring to FIGS. 2 and 4, the cabinet 12 includes flat side panels 12.1 which are generally rectangular in shape and which have a width dimension "W" (FIG. 2) somewhat less than the depth of the locker so that the panels can be easily inserted within the open locker with their outer surfaces 12.2 in contact with or closely adjacent the side walls 10.1 of the locker. Desirably, the dimension "W" is less than the distance from the flanges 10.4 to the rear wall 10.2 of the locker, and in FIG. 4, the side panels are shown as terminating forwardly in an edge 12.3 that is spaced rearwardly from the flanges a short distance. If desired, the width dimension of the panel 12.1 could be increased so as to permit its forward edge 12.3 to nest in the recesses 10.8 formed by the bends in the flanges 10.4, as shown in FIG. 4. The rearward edges 12.4 of the side panels desirably abut the rear wall 10.2 of the locker. As used herein, "forwardly" and "rearwardly" refer to directions from within the locker toward the door opening 10.5 and toward the rear wall 10.2 of the locker, respectively.

Generally rectangular, flat shelf panels, of which four are shown in FIG. 2 as 14, 14.1, 14.2, 14.3, are mounted horizontally between the side panels by mounting means to be described below, the side edges of the shelf panels abutting or being closely adjacent the inner surfaces 12.5 of the side panels. The uppermost shelf panel 14 desirably is positioned slightly below the upper edges 12.6 of the side panels to provide the shelf unit with an upwardly extending "lip" 12.7 along its sides. Uppermost shelf panel 14, in this manner, provides an upwardly facing surface defining the top of the cabinet, and the upwardly extending lips of flanges 12.7 restrain coins or the like from escaping from that upper surface.

The shelf panels 14–14.3 inclusive are parallel and are spaced vertically from one another. The shelf panels 14 and 14.1 may be vertically spaced to define between them a drawer opening 14.4 to receive between them a drawer designated generally as 16. The drawer is parallelepiped in shape and has a bottom 16.1, sides 16.2, a rear wall 16.3, and a front wall 16.4, the latter of which may be provided with an exterior pull knob 16.5. The front wall of the drawer may instead have side edges which may be gripped to pull the drawer outward, or may have finger holes through it for the same purpose. The heighth of the drawer, or at least the front wall 16.4 thereof, is such as to permit the drawer to fit snugly between the shelf panels 14, 14.1 and to slide upon the upper surface of the shelf panel 14.1. Drawer guides 16.6, which may take the form of small blocks of wood, are attached as by gluing to the upper surface of the shelf panel 14.1 along its edges, and abut the edges of the drawer so as to guide the same in its forward and rearward movements. Rearward movement of the drawer is limited by means of a stop 16.7 (FIG. 4), which may take the form of a block of wood, and which is attached to the rear of the shelf panel 14.1. The stop desirably is positioned so that when the drawer is in its fully closed position, as shown in FIG. 4, the front wall 16.4 of the drawer is recessed a short distance, e.g., ¼ inch, from the front edges of the shelf panels 14, 14.1. The width of the drawer is substantially less than the width of the restricted door opening defined by the locker flanges 10.4 so that the drawer can be withdrawn through the door opening. As shown in FIG. 4, the front wall 16.4 of the drawer may be somewhat wider than the remainder of the drawer, but still narrower than the locker door opening, so as to provide side edges or lips 16.9 that can be grasped to pull the drawer open. If desired, the rear wall 16.3 of the drawer may be made wider than the locker door opening to prevent the drawer from being removed entirely from the locker.

With reference to FIGS. 2 and 5, the drawer may be provided with locking means, typified as lock 16.8, to lock the drawer to either of the shelf panels 14, 14.1. The lock may include a key opening and a hook 16.9 that is key-operated to swing into and out of engagement with a lock plate 17, the latter being mounted within a recess in the lower surface of the shelf panel 14.

With reference to FIG. 6, the side panels 12.3 are provided with bracket receiving means typified by an elongated metal strap 18. The ends of the strap are fastened, as by screws, to the inner surfaces 12.5 of the side panels, and the strap is configured so as to provide an elongated slot or gap 18.1 between itself and the side panel to which it is attached. The strap has an upwardly facing surface 18.2 and also a rearwardly facing surface 18.3, the latter surface being shown as the interior, vertical surface of the strap closely adjacent its attachment to the side panel.

Bracket means, typified by an elongated metal strap 20 in FIG. 6 having a generally "L"-shaped cross-section, is affixed to the underside of the shelf panel 14 by means of screws 20.1 or the like, the strap providing a downwardly extending flange 20.2 which desirably is substantially coplaner with the side edges of the shelf panels. The flange is shaped to be received snugly within the slot 18.1 formed by the bracket means 18. Preferably, the flange 20.2 extends outwardly slightly so as to make an angle with the under-surface of the shelf unit to which it is attached of slightly more than 90°, such angle lending rigidity to the union between the bracket means and bracket receiving means. The strap 20 is provided with downwardly and forwardly respective surfaces 20.3 and 20.4 that engage, respectively, the upwardly facing and rearwardly facing surfaces 18.2, 18.3 of the strap 18 when the flange 20.2 is lowered into the slot 18.1. Although the embodiment of FIG. 6 shows a side panel having but a single bracket receiving means and a broken-away portion of a shelf panel having but a single bracket means, it will be understood that the bracket means are disposed on each side of each shelf panel, and the bracket receiving means are mounted to each of the side panels.

The embodiment as shown in FIG. 7 is similar to that shown in FIG. 6, and primed numbers have been used to identify similar but modified elements. In FIG. 7, the bracket receiving means is typified by an elongated strap 18′ which is fastened to the side panel at a plurality of spaced locations along its length by means of screws or the like, the portions of the strap between the points of attachment being so configured as to provide elongated, narrow slots 18.1′ between the body of the strap and the side panel to which it is attached. The strap has an upper surface 18.2′, and each of the slots 18.1′ is bounded at its forward end by a rearwardly facing surface 18.3′. The bracket means typified by elongated strap 20′, has a plurality of spaced, downwardly extending flanges 20.2′ which are configured to be received within the slots 18.1′. The strap 20 has a downwardly facing surface 20.3′ and the flanges have forwardly facing surfaces 20.4′ which engage the respective upwardly and rearwardly facing surfaces 18.2′, 18.3′ of the strap 18 when the flanges 20.2′ are lowered into the slots 18.1′. The mounting means shown in FIG. 7 is somewhat more rigid than the mounting means shown in FIG. 6, but also is somewhat more expensive to fabricate. Since the shelf unit is not expected to be required to bear great weight when in use, and will gain support from the walls of the locker in which it is assembled, the mounting means depicted in FIG. 6 is preferred.

As will be more fully explained below, it may be desirable in some instances to rigidly attach a shelf panel to the side panels. This may be accomplished by threading screws into the side panels through the preformed, aligned holes 18.4, 20.5 formed in the bracket receiving means and the bracket means, respectively, of FIG. 6 (the preformed holes being shown, respectively, as 18.4', 20.5' in the embodiment of FIG. 7).

To assemble the cabinet within an existing locker, one first places the side panels 12.1 in contact with the side walls 10.1 of the locker. For ease of assembly, the lower shelf panel (14.3 in FIG. 2) is then inserted in the locker and is lowered into place with its bracket means being received in the appropriately positioned bracket receiving means of the side panels. The shelf panels 14.2, 14.1 and 14 are then sequentially mounted in the same manner between the side panels, and finally, the drawer is installed between the shelf panels 14, 14.1. In the event that the locking means (16.8 in FIG. 5) is to be employed to prevent removal of the drawer, then one first mounts the uppermost shelf panel 14 between the side panels, screws or other fastening means being employed to secure the bracket means and bracket receiving means together and to prevent their disengagement, as described above. After appropriate mounting of the shelf panels 14.1, 14.2 and 14.3, the drawer 16.4 can be installed as aforesaid. Because of the very small space between the side walls of the drawer and the side panels, it becomes difficult if not substantially impossible for one to reach into these small spaces to unloosen the screws which secure together the mounting means for the uppermost shelf unit 14. Further, because of the presence of the drawer, one cannot lift the shelf panel 14.1 upwardly to disengage it from the side walls, and hence the entire cabinet is retained within the locker. One can readily unloosen the mounting means screws only by unlocking the drawer and removing it from the cabinet, following which access to the screws from the space previously occupied by the drawer can be obtained.

The side and shelf panels of the cabinet may be made of any rigid material, but desirably are of particle board or wood, the forward edges of the panels and drawer being suitably and attractively finished. Particle board having a thickness of one-fourth to three-quarters inches is desired, and a thickness of three-eighths inches has provided good results. The bracket and bracket receiving means preferably are of steel and typically may be on the order of about 0.035 inches in thickness. For most standard lockers, the side panels may be on the order of fifteen inches wide and fifteen to sixteen inches in height. The shelf panels similarly may be on the order of fifteen inches front-to-rear, and, for standard lockers having inside widths of twelve or eighteen inches, the shelf panels may be typically 11-$\frac{1}{8}$ or 17-$\frac{1}{8}$ inches wide, respectively.

Inasmuch as lockers are of standardized dimensions, the cabinet of the invention may be supplied in kit form with predetermined shelf panel widths for each standard locker size. In the event that no locking means is desired for the drawer, the kit can be readily assembled in a matter of minutes without the use of tools and, when assembled, provides a cabinet which is rigid and durable and provides readily accessible storage space for shoes, breakable personal items, athletic equipment, clothing and the various other items now commonly stored in lockers.

While we have described a preferred embodiment of the present invention, it should be understood that various changes, adaptations, and modifications may be made therein without departing from the spirit of the invention and the scope of the appended claims.

What is claimed is:

1. A kit for assembling a cabinet within a standard locker having rear and side walls and front flanges extending inwardly of the side walls to define a locker door opening, the kit comprising side panels for vertical placement against interior surfaces of the side walls of the locker, the side panels having bracket receiving means on their confronting surfaces including upwardly facing surfaces and rearwardly facing surfaces, and at least one shelf panel positionable horizontally between the side panels with its side edges confronting the respective surfaces of the side panels and spacing the side panels apart a sufficient distance as to prevent their forward removal through the locker door opening, the shelf panel having bracket means including means insertable downwardly into the bracket receiving means, the bracket means having surfaces respectively engageable with the upwardly facing and rearwardly facing surfaces of the bracket receiving means of the side panels for preventing respective downward and forward movement of the shelf panel with respect to the side panels.

2. The kit of claim 1 including upper and lower shelf panels, the bracket receiving means being arranged to support the upper shelf panel in confronting, horizontal, spaced relation above the lower shelf panel, the kit including a drawer sized to fit closely between said shelf panels, the drawer having a width substantially less than the shelf panels to permit the drawer to be withdrawn forwardly through the locker opening between the front flanges thereof.

3. The kit of claim 2 including attaching means preventing upward removal of the upper shelf panel from the side panels, and locking means for locking the drawer to one of the shelf panels to prevent withdrawal of the drawer from between the shelf panels.

4. The kit of claim 2 including drawer guide means carried by the lower shelf panel for limiting movement of the drawer forwardly and rearwardly of the shelf unit.

5. In combination:

(a) A locker having vertical rear and side walls, a floor, and front flanges extending inwardly of the side walls to define a locker door opening;

(b) A cabinet assembled within said locker, the cabinet comprising:

(i) parallel, spaced side panels arranged in confronting relationship with respect to the respective side walls of the locker and having lower edges supported by the locker floor;

(ii) at least one shelf panel positioned horizontally between the side panels and positively spacing the side panels a sufficient distance to prevent their forward removal between the front flanges of the locker; and (iii) mounting means mounting the at least one shelf panel to the side panels.

6. The combination of claim 5 including a pair of shelf panels mounted between the side panels in horizontal, spaced relationship, and a drawer sized to fit closely between the panels, the drawer having a width permitting it to pass freely through the locker door opening between the front flanges thereof.

7. In combination:

(a) A locker having vertical rear and side walls, a floor, and front flanges extending inwardly of the side walls to define a locker door opening;

(b) A cabinet assembled within said locker, the shelf unit comprising (i) parallel, spaced side panels arranged in confronting relationship with respect to the respective side walls of the locker and having lower edges supported by the locker floor, the side panels including bracket receiving means rigidly carried by confronting surfaces of the side panels and having respective rearwardly facing and upwardly facing surfaces; and (ii) at least one shelf panel positioned horizontally between the side panels, the shelf panel including bracket means engageable downwardly with the bracket receiving means and having respective forwardly facing and downwardly facing surfaces engaging the respective rearwardly facing and upwardly facing surfaces of the bracket receiving means to prevent forward movement of the shelf panel with respect to the side panels, the bracket means and bracket receiving means being so positioned and arranged as to carry the shelf panel horizontally and at a predetermined heighth above the locker floor, and the shelf panel positively spacing the side panels apart a sufficient distance to prevent their forward removal between the front flanges of the locker.

8. A kit for assembling a cabinet within a locker having rear and side walls and front flanges extending inwardly of the side walls to define a locker door opening, the kit comprising side panels for vertical placement against interior surfaces of the side walls of the locker, the side panels having, receiving means on their confronting surfaces, and at least one shelf panel positionable horizontally between the side panels with its side edges confronting the respective surfaces of the side panels, the shelf panel having bracket means having downwardly facing surfaces and including means defining a downwardly depending flange at each side of the shelf unit, the flanges having forwardly facing surfaces, the bracket receiving means including means defining an upwardly open recess sized to snugly receive the respective flange of the bracket means and having respective rearwardly and upwardly facing surfaces for respective engagement with the forwardly and downwardly facing surfaces of the bracket means for preventing respective downward and forward movement of the shelf panel with respect to the side panels.

9. In combination:

(a) A locker having vertical rear and side walls, a floor, and front flanges extending inwardly of the side walls to define a locker door opening;

(b) A cabinet assembled within said locker, the cabinet comprising (i) parallel, spaced side panels arranged in confronting relationship with respect to the respective side walls of the locker and having lower edges supported by the locker floor, the side panels including bracket receiving means rigidly carried by confronting surfaces of the side panels and having respective rearwardly facing and upwardly facing surfaces; and (ii) upper and lower shelf panels positioned horizontally between the side panels, the shelf panels including bracket means engageable downwardly with the bracket receiving means and having respective forwardly facing and downwardly facing surfaces engaging the respective rearwardly facing and upwardly facing surfaces of the bracket receiving means to prevent forward movement of the shelf panels with respect to the side panels, the bracket means and bracket receiving means being so positioned and arranged as to support the upper shelf panel in confronting, horizontal, spaced relationship above the lower shelf panel and at a predetermined heighth about the locker floor, the shelf panels positively spacing the side panels apart a sufficient distance to prevent their forward removal between the front flanges of the locker, and a drawer sized to fit closely between such shelf panels, the drawer having a width substantially less than the shelf panels to permit the drawer to be withdrawn forwardly through the locker door opening between the front flanges thereof.

10. The combination of claim 9 including attaching means, access to which is obstructed by the drawer, for preventing upward removal of the upper shelf unit from the side panels, and locking means for locking the drawer to one of the shelf panels, the locking means and attaching means coacting to prevent disassembly of the upper and lower shelf panels from the side panels and thus preventing removal of the cabinet from the locker.

* * * * *